US005439520A

United States Patent [19]

Reich

[11] Patent Number: 5,439,520

[45] Date of Patent: Aug. 8, 1995

[54] APPLICATOR FOR COATING WEBS OF PAPER OR CARDBOARD

[75] Inventor: Stefan Reich, Heidenheim, Germany

[73] Assignee: Voith Sulzer Papiermaschinen GmbH, Heidenheim, Germany

[21] Appl. No.: 116,264

[22] Filed: Sep. 2, 1993

[30] Foreign Application Priority Data

Sep. 10, 1992 [DE] Germany ..... 42 30 241.2

[51] Int. Cl.[6] ..... B05C 1/04

[52] U.S. Cl. ..... 118/410; 118/256; 118/413; 118/419

[58] Field of Search ..... 118/410, 419, 413, 256; 427/356

[56] References Cited

U.S. PATENT DOCUMENTS

| | | | |
|---|---|---|---|
| 4,250,211 | 2/1981 | Damrau et al. | 118/413 |
| 4,534,309 | 8/1985 | Damrau et al. | 118/410 |
| 4,594,963 | 6/1986 | Krautzberger | 118/410 |
| 4,834,018 | 5/1989 | Sollinger et al. | 118/410 |
| 4,869,933 | 9/1989 | Sollinger et al. | 427/356 |
| 4,920,913 | 5/1990 | Knop | 118/410 |
| 4,945,855 | 8/1990 | Eklund et al. | 118/410 |
| 5,104,697 | 4/1992 | Heikkinen et al. | 118/410 |
| 5,112,653 | 5/1992 | Damrau et al. | 118/413 |
| 5,199,991 | 4/1993 | Chance | 118/410 |

FOREIGN PATENT DOCUMENTS

| | | | |
|---|---|---|---|
| 0029865 | 10/1982 | European Pat. Off. . | |
| 2199516 | 7/1988 | United Kingdom | 118/410 |

*Primary Examiner*—W. Gary Jones
*Assistant Examiner*—Laura E. Edwards
*Attorney, Agent, or Firm*—Baker & Daniels

[57] ABSTRACT

The invention relates to an applicator for coating webs of paper or cardboard, with a backing roll for supporting the web at least in the area of the applicator, and with a nozzle for supplying coating mixture. The nozzle is connected to or integrated with a support beam. A guide surface has an angular, sharp parting edge on the end of the guide surface and is attached to the support beam. The guide surface—toward the parting edge—steadily approaches the shell surface of the backing roll, while in the area of the parting edge deviating at an angle between 0°–10° from the tangential direction of the backing roll existing adjacent the parting edge. The guide surface and the backing roll define an applicator gap in which a hydrodynamic pressure prevails.

10 Claims, 3 Drawing Sheets

W
22
23
1
10
2
11
15
3
14
13
12
34
21
46
47
24
25
32

APPLICATOR FOR COATING WEBS OF PAPER OR CARDBOARD

BACKGROUND OF THE INVENTION

The present invention is directed to an applicator system for coating fiber webs, the applicator system including a nozzle for feeding coating mixture and a backing roll.

Such an applicator system is known from U.S. Pat. No. 4,920,913, which discloses a complete applicating and finish dosing system for the coating of paper or cardboard. A dosing element in the form of a doctor blade is provided at the end of an applicator gap which is formed by a guide surface extending essentially parallel to the shell surface of the backing roll supporting the web. The coating mixture is fed to the paper web, or to the entrance end of the applicator gap, by a nozzle channel. Illustrated and described in this patent document are applicator systems fashioned after the system of the short-dwell applicator systems. All of these are applicator systems used primarily with papers of medium quality. They enable medium and very light basis weight applications.

SUMMARY OF THE INVENTION

The present invention provides an applicator system which features the characteristics of conventional roll applicator systems which use a so-called scoop roll, intending specifically to maintain also the progression of the hydrodynamic pressure in the applicator gap that is characteristic for the scoop roll application. This pressure progression involves a relatively strong anchoring, or predewatering, of the coating mixture. This, less than the different reaction time, is the quality-determining difference between a roll applicator and a strictly nozzle type applicator.

Taking place here is an anchoring of a coating mixture by means of a pressure pulse between the web of paper or cardboard and a stationary gap slat, or its guide surface, facing the web. The characteristics of the coating application by the roll applicator are extensively adopted, such as —volumetric predosing by way of an applicator gap of fixed adjustment;

—pressure penetration of the coating mixture, or of the coating water, in the paper by hydrodynamic pressure in the converging applicator gap;

—the stretch of prewetting by the coating mixture can be determined by design and by the flow of the coating mixture.

The system can be employed also as a predosing applicator and, as the case may, applied onto the bare roll shell.

A further preferable provision may be that the applicator gap is variable by adjustment of a nozzle and of the beam supporting the doctor slat featuring the guide surface, by means of lead screws.

Hydraulic or pneumatic cylinders or air bellows are usable as well.

Furthermore, for variation of the form of the applicator gap, the entire applicator may pivot about a pivot axis which is parallel to the backing roll, thereby providing an option for optimizing the progression of the pressure. A gap shape differing only little from the usual roll gap of the roll applicator can be effected by suitable shaping of the component (doctor slat) forming the applicator gap, or the appropriate guide surface.

On the other hand, the gap shape may also be modeled on the roll gap by using a crowned doctor slat, or the doctor slat may also be equidirectionally curved relative to the backing roll for variation of the pressure progression. To achieve in the applicator gap conditions of flow for the coating substance that are comparable to those with strictly scooping roll type applicators, the gradient of shear dv/ds needs to be adjusted similarly. The higher relative speed between paper web and doctor slat resulting from the applicator roll being driven in synchronism with the web speed at about 15% of same, with the present object of the invention, leads to a higher gradient of shear, which can be compensated for by slightly increasing the minimum applicator gap, i.e., on the end of the doctor slat, or of the guide surface of same.

The stretch of prewetting, i.e., the length of the entire applicator gap, may be fashioned similar to the scoop roll applicator.

Occurring here, the same as with the scoop roll applicator, is a reflux of surplus coating mixture opposite to the direction of web travel, which prevents air from penetrating in the applicator gap. As a result, skips do not occur at high speeds. The overflow slat installed at the end of the nozzle channel may vary in shape. By appropriate shaping of the overflow it is possible to create very narrow channels (or gaps), thereby reducing turbulences such as occurring in the ink sump on the scoop roll applicator.

Moreover, the disadvantage of a disuniform prewetting of the web by coating mixture splashing in the sump does not occur.

A significant advantage is the prevention of film splitting by a sharp trailing edge of the guide surface.

A better so-called "runnability" can be achieved by a somewhat enlarged minimum gap at the end of the guide surface.

There is the additional advantage that a controlled-RPM applicator roll drive becomes dispensable; eliminated also is an appropriate jointed shaft. Lastly, the system also is very easy to retrofit and convert. There are reduced height dimensions realizable, and a retreading and regrinding of the applicator roll is dispensable.

An applicator using a dosing element which is fashioned as a carrier pivoting about an axis parallel to the backing roll supporting the web and features a convex guide surface is known from EP 29865 A1, which forms an applicator gap on the web and extends on the web departure side in a sharp, or abrupt, terminal edge. However, a variant uses here a trough of coating mixture on the web running between a reversing roll and the backing roll and, arranged thereafter, the rigid dosing element on the paper web or backing roll—pivotable, as the case may be, about an axis parallel to the backing roll. The trough has an outlet gap, and it remains unclear where the surplus coating mixture is left which from the trough flows to the rigid dosing element from above. The conditions of flow on, or in the applicator gap remain completely unclear.

BRIEF DESCRIPTION OF THE DRAWINGS

The invention will be more fully explained hereafter with the aid of the embodiments illustrated in the figures, in which, as a basic cross section.

DETAILED DESCRIPTION OF THE INVENTION

Figure 1:
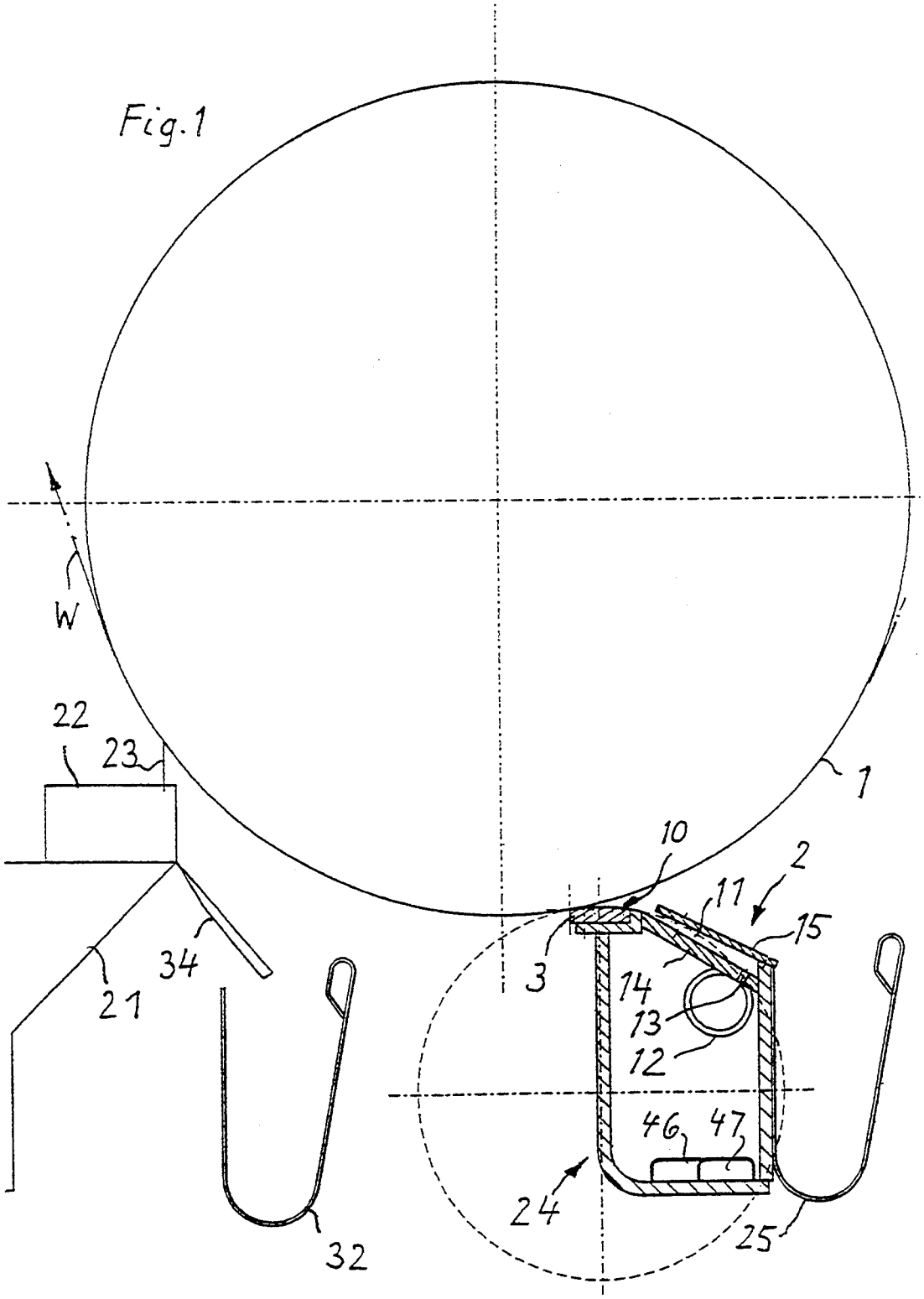
FIG. 1 is an overall arrangement of an embodiment of the inventional coating system.
Figure 11:
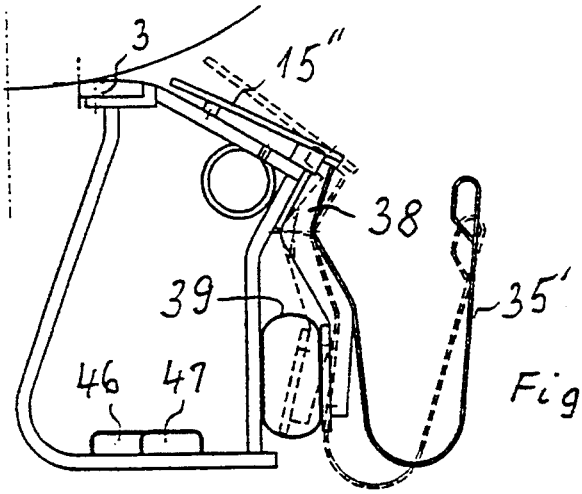
FIG. 11 is an embodiment with a hinged nozzle wall.

Referring now to FIG. 1, backing roll 1 supports web W, while 2 marks the nozzle with the nozzle channel 11, and 3 signifies the coating slat which forms, or features, the applicator gap (not numbered), the guide surface 10, which is essentially non-deflectable, and the sharp parting edge 6 (refer to FIG. 2) for purposed of the present application, the term "sharp edge" as it pertains to guide surface 10 means two abutted surfaces that are not disposed in a common plane and form an outside corner that defines a line. Coating slat 3 is arranged, essentially rigidly, on a support beam 24, such that guide surface 10 at parting edge 6 is less disposed at an angle of less then or equal to 10° relative to a plane extending tangent to backing roll 1 at a location adjacent to parting edge 6. However, as will be illustrated in greater detail with the aid of FIG. 12, support beam 24 may also be pivotable. To be provided, specifically, is an adjustment of support beam 24 in vertical direction relative to the coating slat 3, or the direction from its guide surface near its terminal edge on the web departure side. This makes it possible to adjust the minimum width of the applicator gap, on the parting edge of coating slat 3, and the pivotability allows effecting a control of the hydrodynamic pressure progression through the changed gap shape. Nozzle channel 11 is illustrated here with a width diminishing toward its outlet end; but it may also feature a constant width. Nozzle channel 11 is supplied via a distribution pipe 12 which—the same as the components essentially illustrated here—extends across the length of the backing roll 1 and features discharge bores 13 for the coating substance, distributed across its length. Wall 14 of nozzle channel 11 is integrated in support beam 24 and the other, terminal wall 15, may also be hinged to support beam 24, as illustrated in FIG. 11. Surplus coating mixture issuing at the end of nozzle channel 11 opposite to the direction of web travel is collected by a collection tub 25.

Concerned here—in keeping with a scoop roll applicator—is a predosing system or applicator 2, 10, 24, while a follow-up main or finish dosing system 22 with a doctor blade 23 is provided adjacent backing roll 1. The surplus coating mixture doctored off here proceeds via a plate 34 to a further collection tub 32. The finish dosing system 22 is supported by a further support beam 21.

Figure 2:
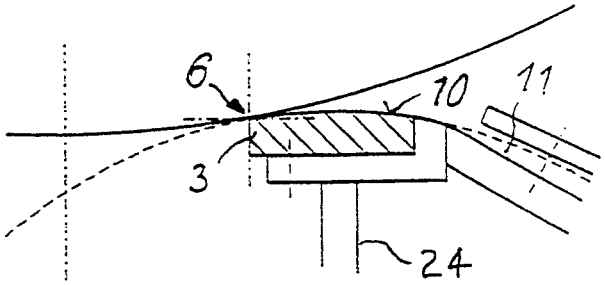

Evident from FIGS. 1 and 2 is a steady transition of the coating mixture flow from the nozzle channel 11 to guide surface 10 of coating slat 3.

In FIGS. 1 and 2, coating slat 3—the same as the scoop roll indicated by the curved broken line—forms a guide surface 10 curved in accordance with its radius, with an angular, or sharp, parting edge 6. The smallest width of the applicator gap and the dosing of the coating mixture occur at parting edge 6.

Figure 3:
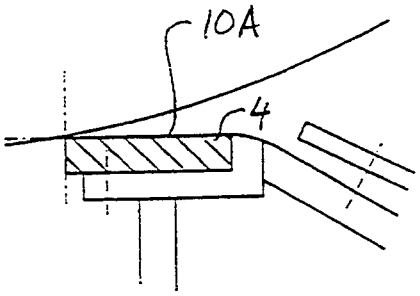
FIGS. 2–4 are various embodiments of the doctor slat forming the applicator gap.
Figure 4:
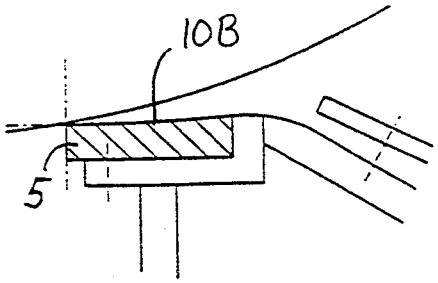

Possible are also other guide surface shapes, for instance a flat guide surface 10A according to FIG. 3, forming there on coating slat 4. Possible as well is a convex guide surface 10B according to FIG. 4, on an appropriately fashioned coating slat 5.

Basically, it can be said that coating slats 3, 3′, 3″, 4, 5 are made of a very wear-resistant material, or that guide surface 10, 10A, 10B is made wear-resistant by an appropriately wear-resistant coating with hard chrome, ceramic or similar. Possible, furthermore, is a finish grinding of guide surface 10, 10A, 10B.

Figure 5:
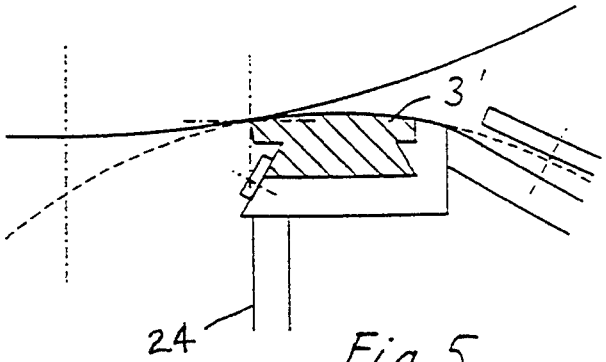
FIGS. 5–6 are embodiments of doctor slat mountings.
Figure 6:
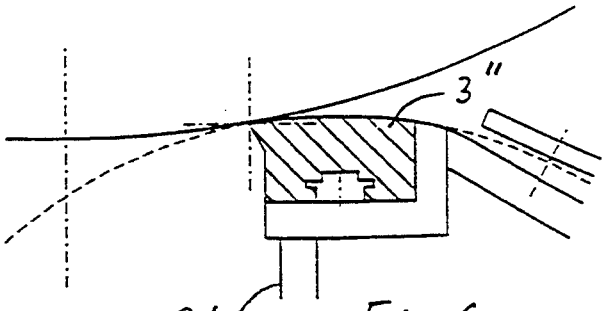

FIG. 2 shows a simple screw mounting of coating slat 3 on support beam 24. However, variants of this mounting using dovetailing or T-slotting are possible such as illustrated in FIGS. 5 and 6.

FIGS. 7–10 show variants of overflow slats which terminate the applicator gap on the web entrance side on the end of nozzle channel 11, 11′, 11″, etc.

Figure 7:
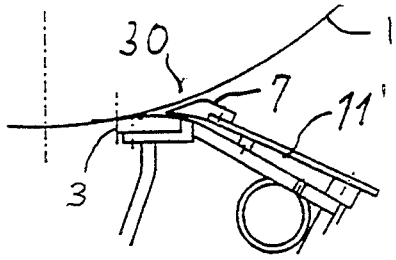
FIGS. 7–10 are various embodiments of overflow slats at the end of the nozzle channel on the entrance side of the web.

FIG. 7 illustrates an overflow slat 7 having a point which reaches far into the applicator gap formed between coating slat 3 and backing roll 1, and which adjacent backing roll 1 forms a narrow backflow gap 30 between 2–8 mm. Turbulences are very extensively avoided by such design.

Figure 8:
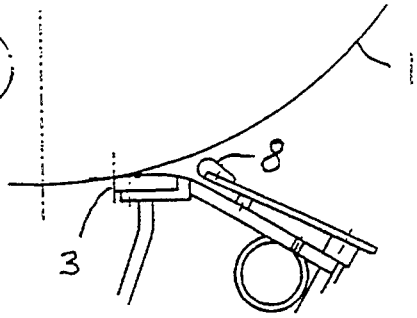

FIG. 8 illustrates an overflow slat 8 configured with a relatively round terminal edge, the applicator gap remaining relatively spacious.

Figure 9:
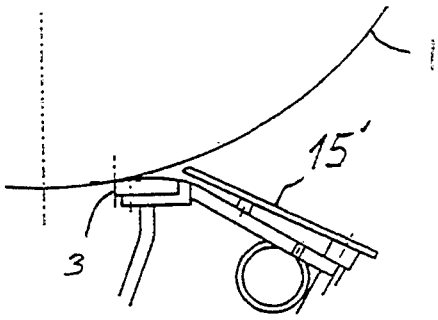

FIG. 9 shows only a simple extension of the nozzle channel terminal wall 15′ on the web entrance side.

Figure 10:
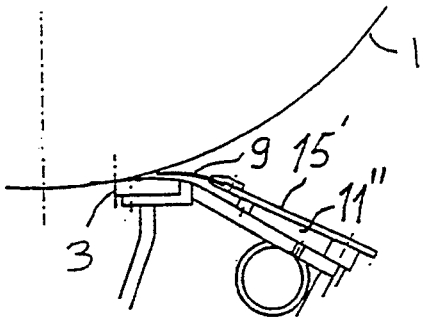

FIG. 10 illustrates a terminal wall 15′ of nozzle channel 11″ on the web entrance side, which is extended by a flexible element 9 which protrudes far into the applicator gap formed between coating slat 3 and backing roll 1, and which forms adjacent backing roll 1 a narrow gap between 1 and 5 mm. Flexible element 9 is self-adjusting and divides the coating mixture flows automatically at the appropriate ratio. Achieved thereby is a flow control with very little turbulence.

FIG. 11 illustrates the pivotability of nozzle channel terminal wall 15″ on the web entrance side, for cleaning purposes, by means of a lever wall 38 and a pressure hose 39. Collection tub 35′ pivots simultaneously.

Figure 12:
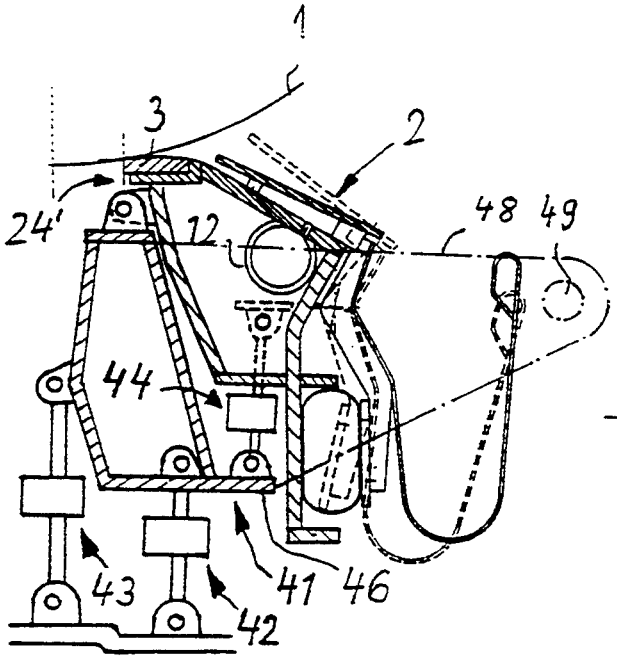
FIG. 12 is an overall arrangement with lead screws, or actuators, for appropriate support beams of the applicator.

FIG. 12 shows a comparable setup, but there are two different support beams—24′ and 41—provided here, of which support beam 24′ supports coating slat 3 and nozzle 2 as well as distribution pipe 12.

Support beam 41 supports the other support beam 24′ at its top. There are various jacks in use, i.e., jacks 41–44, which are preferably fashioned as lead screws. Lead screw 44 extends between a lower plate 46 of the lower support 41 and the support beam 24′ and pivots support beam 24 with the components contained thereon. This makes it possible to modify the gap geometry of the applicator gap.

Lower support beam 41 is adjustable by jacks 42 and 43 toward the backing roll 1, or—expressed more accurately—in a direction perpendicular to the coating slat 3, or guide surface 10 of it as concerns its direction in the area of its parting side terminal edge. Possible thereby is adjusting a narrow width of the applicator gap—on the end of the guide surface 10, or parting edge 6. This allows an exact adjustment of the predosing quantity.

Also provided may be (as indicated by dash-dot line) a large support lever with a pivot 49, which would make jack 43 dispensable. Parting edge 6 on guide surface 10 of coating slat 3, 4, 5 may be relatively sharp, i.e., its rounding radius amounting to maximally 0.5 mm.

FIGS. 1 and 11 additionally illustrate that a temperature equalization of the support beam can be effected through liquid channels 46 and 47, when using heated coating mixture. This allows a compensation for, or reduction of, the sagging or curvature of the support beam.

Resulting from temperature differences in the beam or also from the hydrodynamic pressure, a sagging may also be balanced by a mechanically operating antisagging system (not shown). The support beam proper may be deformed specifically by pressure hoses bearing on a yoke borne by the support levers.

The geometry of the applicator gap should range within certain limits, for which reason a minimum radius of curvature of the coating slat with a convex design of its guide surface should amount to 140 mm, with a concave design of its guide surface to 400 mm. The length of the applicator gap, or of the coating slat, i.e., in the direction of web travel, ranges between 35 and 120 mm, preferably between 40 and 80 mm.

The angle of the nozzle wall 14 near guide surface 10—at least at the mouth of nozzle 2—with the radial of backing roll 1—in the area of the smallest gap width (at the parting edge of the guide surface 10 drawn into the interior of backing roll 1) amounts favorably to between 120° and 150°.

What is claimed is:

1. An applicator system for use in production of fiber webs, comprising:

an applicator for coating a fiber web; and a backing roll having a shell surface, said backing roll supporting said fiber web at least in an area adjacent said applicator;

wherein said applicator comprises:

a first support beam;

a nozzle for supplying coating mixture, said nozzle being supported by said support beam; and a guide surface connected to said support beam, said guide surface including an angular, sharp parting edge on a downstream end thereof, said guide surface and said shell surface defining a converging flow path, said guide surface at said parting edge disposed at an angle of less than or equal to 10° relative to a plane extending tangent to said shell surface at a location adjacent said parting edge, said guide surface being non-deflectable relative to said backing roll, said guide surface and said backing roll defining an applicator gap therebetween, said applicator gap effecting a hydrodynamic pressure of said coating mixture therein, a plurality of jacks, said applicator mounted to said jacks, said jacks providing adjustment of said applicator relative to said backing roll in at least one direction corresponding to:

a first plane extending generally transverse to said backing roll;

a second plane extending generally transverse to said backing roll and parallel to said first plane;

rotation about an axis extending generally parallel to a longitudinal axis of said backing roll; and wherein said support beam supports said nozzle and said guide surface, and further comprising a second support beam for supporting said first support beam, said second support beam adjustable relative to said backing roll utilizing at least one of said plurality of jacks.

2. The applicator system of claim 1, wherein said first support beam defines a nozzle wall, said nozzle wall having a downstream end and said guide surface having an upstream end, said nozzle wall downstream end and said guide surface upstream end disposed tangent to each other and having a similar curvature.

3. The applicator system of claim 1, wherein said guide surface has a length between 35 and 120 mm.

4. The applicator system of claim 1, wherein said guide surface has a length between 40 and 80 mm.

5. The applicator system of claim 1, wherein said guide surface is configured having at least one of:

a convex surface with a minimum radius of curvature of 140 mm; and a concave surface with a minimum radius of curvature of 400 mm.

6. The applicator system of claim 1, wherein said nozzle includes an overflow slat, said overflow slat and said backing roll defining a narrow gap between 2–8 mm.

7. The applicator system of claim 6, wherein said nozzle includes a terminal wall, said overflow slat comprising an extension of said terminal wall, and having an end at a downstream end thereof which extends into said applicator gap.

8. The applicator system of claim 1, wherein said nozzle includes a terminal wall, and further comprising a flexible element attached to said terminal wall and extending into said applicator gap, said flexible element having a downstream end disposed a distance between 1–5 mm from said backing roll.

9. The applicator system of claim 1, said jacks providing adjustment of said applicator relative to said backing roll in a direction generally perpendicular to said parting edge.

10. The applicator system of claim 1, wherein said first support beam defines a nozzle wall, said nozzle wall having a downstream end defining a surface which is disposed at an angle between 120°–155° relative to a plane extending tangent to said shell surface at a location adjacent said parting edge.

* * * * *